US008376914B2

(12) United States Patent
Avrett

(10) Patent No.: US 8,376,914 B2
(45) Date of Patent: Feb. 19, 2013

(54) AQUATIC EXERCISE DEVICE

(76) Inventor: Pamela Josephine Avrett, Modock, SC (US)

( * ) Notice: Subject to any disclaimer, the term of this patent is extended or adjusted under 35 U.S.C. 154(b) by 272 days.

(21) Appl. No.: 12/804,371

(22) Filed: Jul. 20, 2010

(65) Prior Publication Data

US 2012/0021878 A1 Jan. 26, 2012

(51) Int. Cl.

| | |
|---|---|
| ***A63B 31/00*** | (2006.01) |
| ***A63B 71/00*** | (2006.01) |
| ***B63C 9/08*** | (2006.01) |
| ***B63C 9/28*** | (2006.01) |

(52) U.S. Cl. ..... 482/55; 482/139; 441/129

(58) Field of Classification Search ..... 482/10–11, 482/23–24, 44–51, 55–56, 79, 81, 91–93, 482/105–18, 110–111, 121–122, 124–126, 482/131–132, 139, 141, 148, 907; 441/55–56, 441/59–61, 65–67, 76–79, 81, 122, 129–131; 446/153; 434/247, 254; D21/457, 662, 672, D21/678, 680–685, 692, 760, 803–806

See application file for complete search history.

(56) References Cited

U.S. PATENT DOCUMENTS

| | | | | |
|---|---|---|---|---|
| 4,549,871 | A * | 10/1985 | Verney | 441/81 |
| 4,671,507 | A | 6/1987 | Huttner | |
| 4,689,030 | A | 8/1987 | McWaters | |
| 4,804,177 | A | 2/1989 | Rosson | |
| 4,861,300 | A * | 8/1989 | Casagrande et al. | 441/81 |
| 4,938,477 | A * | 7/1990 | Kuervers | 482/105 |
| 4,993,980 | A | 2/1991 | Dulin et al. | |
| 5,000,710 | A | 3/1991 | Bedortha et al. | |
| 5,090,692 | A | 2/1992 | Beasley | |
| 5,096,189 | A | 3/1992 | Beasley | |
| 5,219,317 | A | 6/1993 | Beasley | |
| 5,628,658 | A | 5/1997 | Clifford | |
| 5,667,416 | A | 9/1997 | Barth | |
| D388,489 | S * | 12/1997 | Sikorski | D21/803 |
| 6,551,225 | B1 * | 4/2003 | Romero | 482/146 |
| 7,037,240 | B2 * | 5/2006 | Pemberton | 482/49 |
| D624,136 | S * | 9/2010 | Chen | D21/760 |
| 2006/0014450 | A1 * | 1/2006 | Crumrine | 441/70 |
| 2011/0136633 | A1 * | 6/2011 | Riggs et al. | 482/121 |

OTHER PUBLICATIONS

SwimOutlet.com; Web site print outs from http://www.swimoutlet.com/product_p/1915.htm; visited Jul. 16, 2010; copyright 2010; copyright SwimOutlet.com; (3 pages).

* cited by examiner

*Primary Examiner* — Oren Ginsberg
(74) *Attorney, Agent, or Firm* — Metz Lewis Brodman Must O'Keefe

(57) ABSTRACT

An aquatic exercise device is provided that has a body made of foam that extends 360° about an axis and at least partially defines a central aperture that extends through the axis. The body has an inner half with an outer surface oriented generally towards the central aperture. The body has an outer half with an outer surface oriented generally away from the central aperture. The entire outer surface of the outer half is convex in shape, and the outer surface of the inner half is convex in shape along an arc length of at least 270° of the inner half of the body about the axis. A ledge extends from the inner half and at least partially defines the central aperture.

15 Claims, 10 Drawing Sheets

AQUATIC EXERCISE DEVICE

FIELD OF THE INVENTION

The present invention relates generally to exercise devices. More particularly, the present application involves an aquatic exercise device that provides buoyancy and water resistance to allow the user to engage in a variety of different exercises.

BACKGROUND

Physical exercise is a daily activity for many members of today's society. Certain types of exercise provide benefits but may also endanger the health of the person performing the exercise. For example, running or jogging on an asphalt surface may have consequences on the long term health of the runner's knees. Also, the use of free weights may be problematic in that they may fall onto the user during a lift thus harming the user and ultimately requiring the use of a spotter during the work out. Aquatic exercise overcomes problems associated with other forms of exercise in that hard, forceful impact of the user's feet are eliminated thus reducing strain imparted onto the user's joints brought about when running on a hard surface. Further, the resistance to motion in aquatic exercise is generated by water resistance or viscosity and thus eliminates the possibility of being hurt or injured through the use of free weights. In addition to maintaining the physical health of the individual, aquatic exercise may be used when rehabilitating from an injury or enhancing movement with respect to certain conditions such as arthritis.

Aquatic exercise takes advantage of a person's natural buoyancy in a body of water. In this regard, elderly or injured individuals may have a portion of their body weight supported by the water allowing the individual to exercise without having to support his or her entire body weight thus making exercise possible. An aquatic exercise device may be used by the individual to further increase the buoyancy of the individual and to provide resistance to movement in the water thus increasing the effectiveness of the exercise. One such device is a shoe that is strapped onto the foot of the user. The user may walk, jog or run while immersed within the water to obtain superior exercise results when compared to conventional walking, jogging or running. Although capable of being strapped onto the foot of the user and allowing for running type exercises, this aquatic exercise device cannot be used if not on the foot of the user and is shaped in such a way that the surface around which water is directed is not uniform thus causing the user to be pushed in a particular direction upon use.

A different type of aquatic exercise device includes a clamping mechanism that allows the device to be secured to a calf of the user. The device includes upper and lower inflatable chambers that can be filled with air to afford the user with a desired degree of buoyancy. This device is not capable of being attached to the foot or hands of the user and is not readily removable in case of an emergency is limited in the amount and variety of exercises one can perform. Current aquatic exercise devices are not capable of being used with a wide range of exercises and are not structured in a safe or user friendly manner. As such, there remains room for variation and improvement within the art.

BRIEF DESCRIPTION OF THE DRAWINGS

A full and enabling disclosure of the present invention, including the best mode thereof, directed to one of ordinary skill in the art, is set forth more particularly in the remainder of the specification, which makes reference to the appended Figs. in which.

Figure 1:
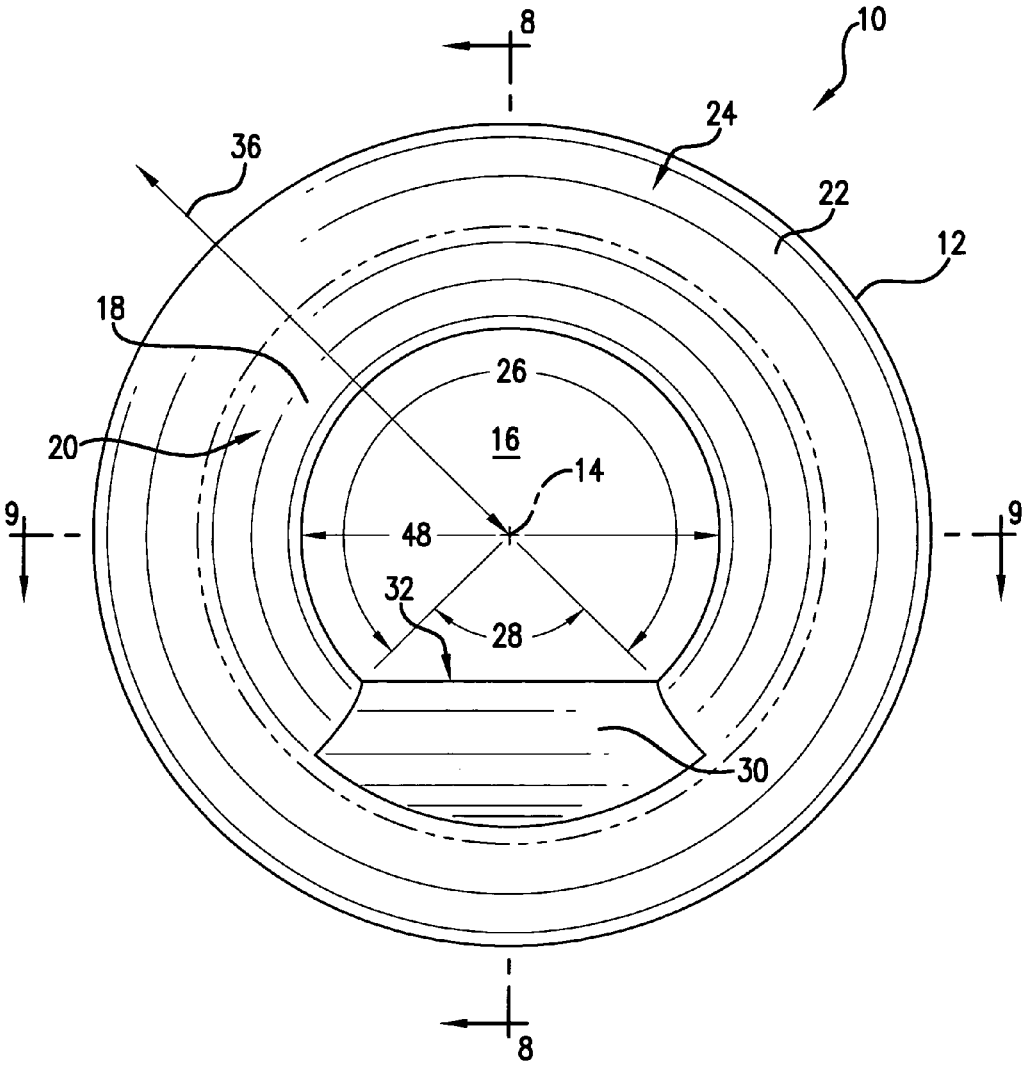
FIG. 1 is a front view of an aquatic exercise device in accordance with one exemplary embodiment.
Figure 2:
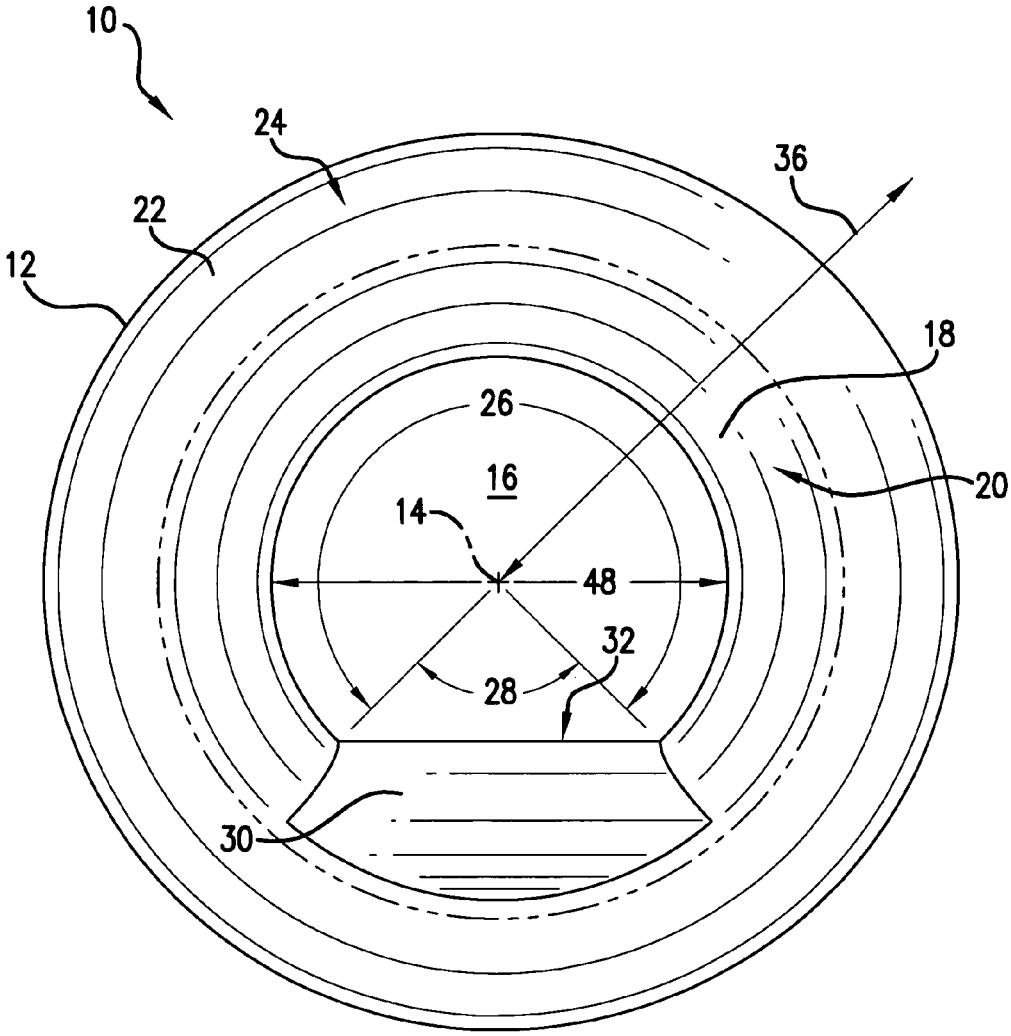
FIG. 2 is a back view of the device of FIG. 1.
Figure 3:
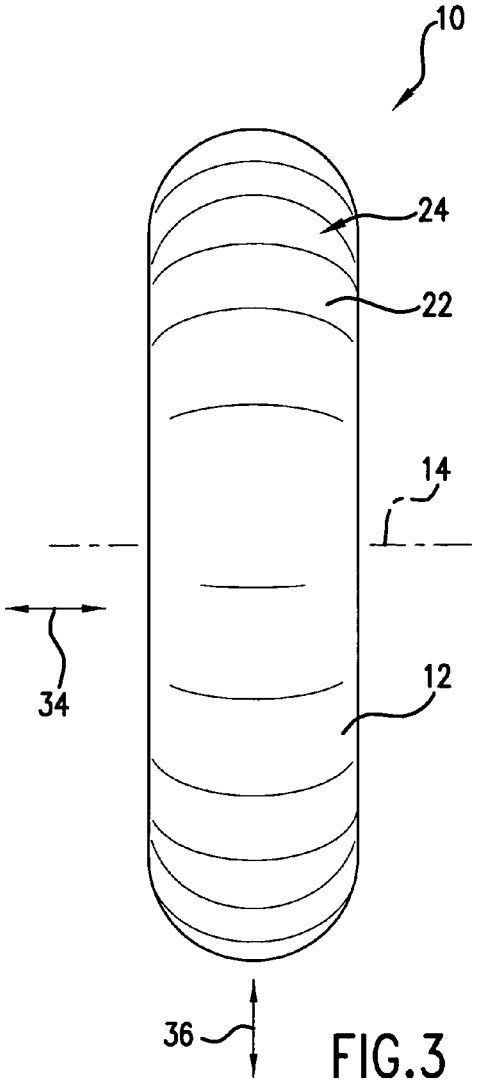
FIG. 3 is a right side view of the device of FIG. 1.
Figure 4:
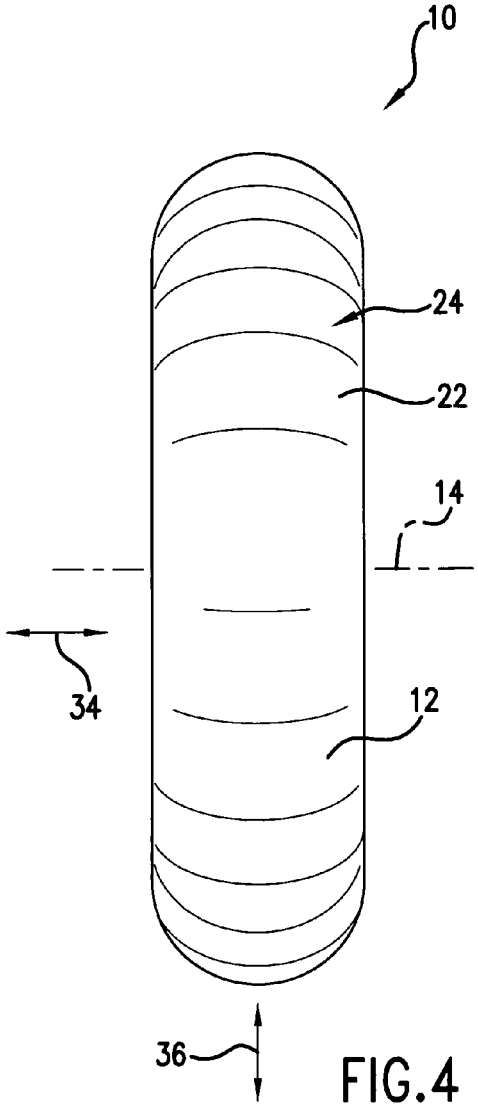
FIG. 4 is a left side view of the device of FIG. 1.
Figure 5:
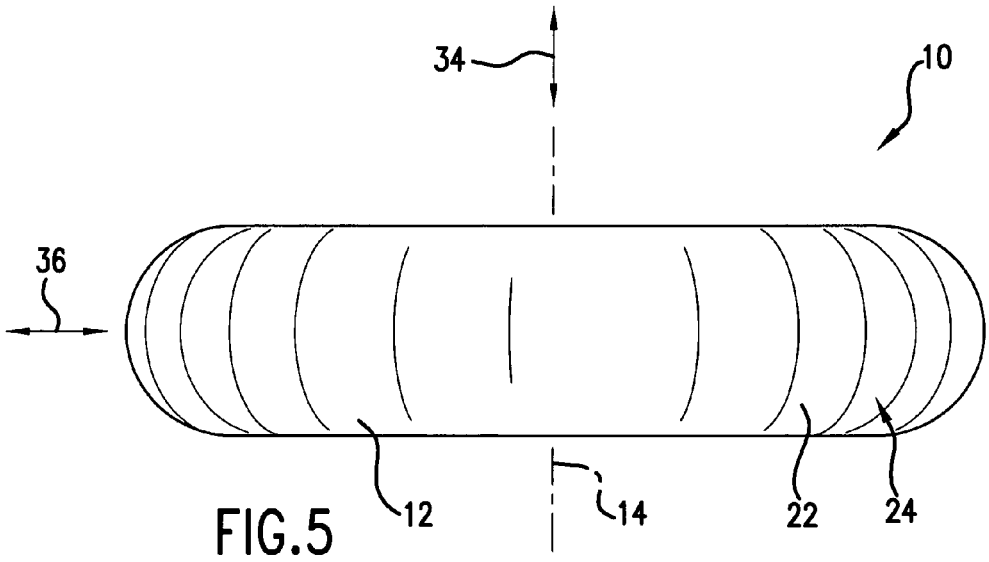
FIG. 5 is a top view of the device of FIG. 1.
Figure 6:
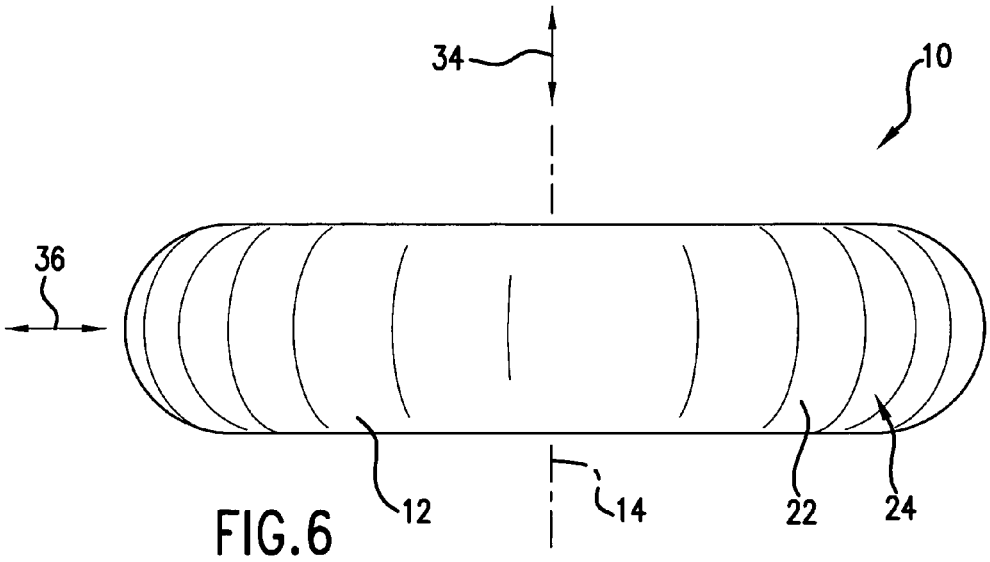
FIG. 6 is a bottom view of the device of FIG. 1.
Figure 7:
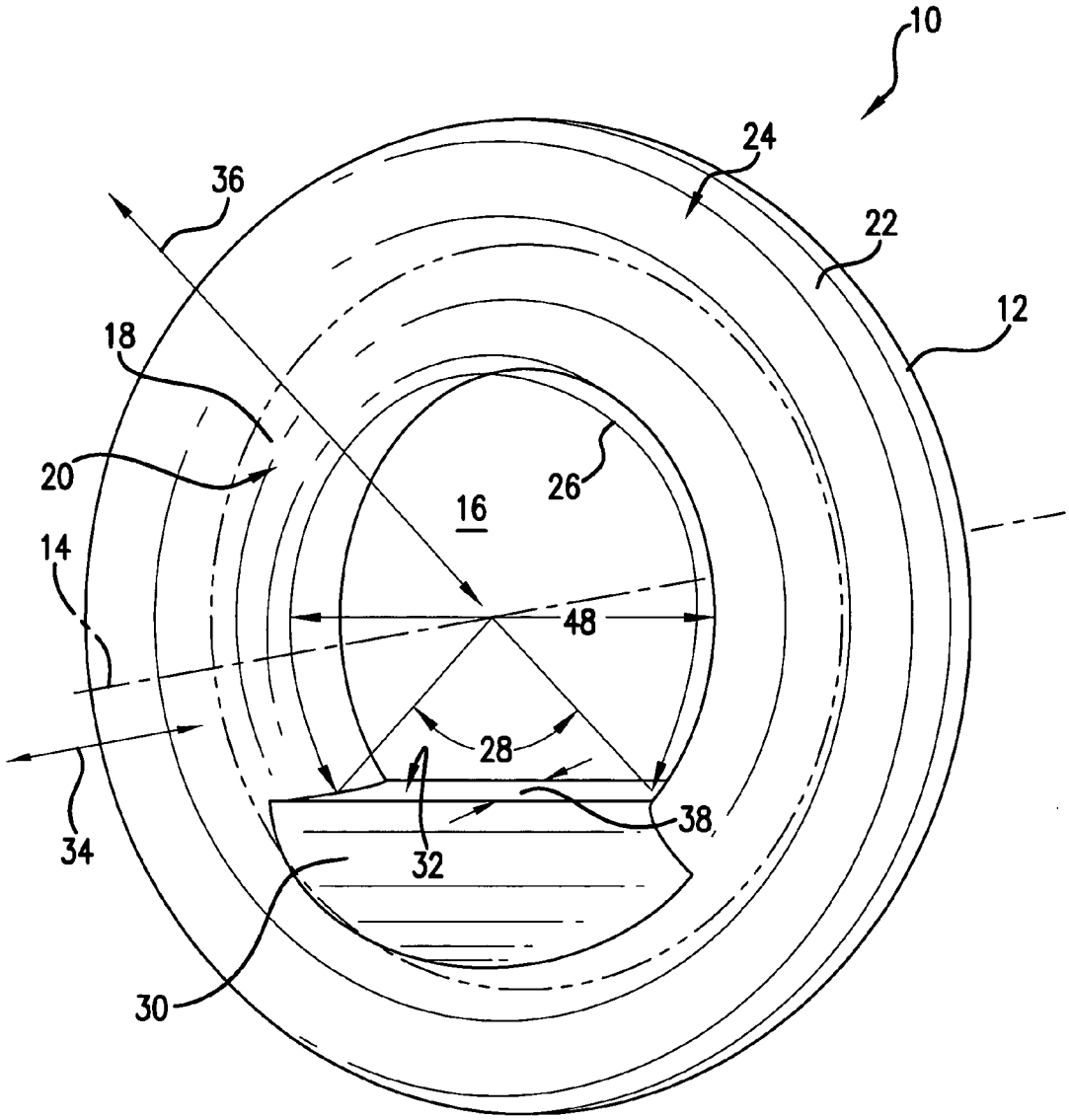
FIG. 7 is a perspective view of the device of FIG. 1.

Repeat use of reference characters in the present specification and drawings is intended to represent the same or analogous features or elements of the invention.

DETAILED DESCRIPTION OF REPRESENTATIVE EMBODIMENTS

Reference will now be made in detail to embodiments of the invention, one or more examples of which are illustrated in the drawings. Each example is provided by way of explanation of the invention, and not meant as a limitation of the invention. For example, features illustrated or described as part of one embodiment can be used with another embodiment to yield still a third embodiment. It is intended that the present invention include these and other modifications and variations.

It is to be understood that the ranges mentioned herein include all ranges located within the prescribed range. As such, all ranges mentioned herein include all sub-ranges included in the mentioned ranges. For instance, a range from 100-200 also includes ranges from 110-150, 170-190, and 153-162. Further, all limits mentioned herein include all other limits included in the mentioned limits. For instance, a limit of up to 7 also includes a limit of up to 5, up to 3, and up to 4.5.

The present invention provides for an aquatic exercise device 10 that may fully or partially support the weight of a user in a pool of water, and that allows the user to perform various aquatic exercises. The user may place his or her foot 42 into a central aperture 16 of the device 10 and rest his or her foot 42 onto a ledge 30. The aquatic exercise device 10 imparts buoyancy onto the user thus assisting the user in remaining afloat while performing various exercises. The device 10 can also provide water and/or buoyancy resistance to the user when moving his or her feet 42 to improve strength or cardiovascular fitness when exercising. The user may quickly and easily remove his or her foot 42 from the device 10 in case of an emergency as the device 10 may be configured with a lack of restraining straps or other attachment means. The user may hold the aquatic exercise device 10 with his or her hand when performing other exercises, and the buoyancy properties and/or water resistance properties of the device 10 will improve the quality of the work out.

FIGS. 1-7 illustrate an aquatic exercise device 10 in accordance with one exemplary embodiment. The device 10 includes a body 12 that can be made of a material having a density less than the density of water so that the body 12 has buoyancy properties. Generally, the density of water is 62.4 pounds per cubic foot, and the body 12 may be constructed of a material that has a density less than this amount. The body 12 may be made of closed cell polyethylene foam and may have a density of 2.3 pounds per cubic foot, 4 pounds per cubic foot, or 6 pounds per cubic foot in certain exemplary embodiments. The density of the body 12 may be from 1 to 10 pounds per cubic foot, from 10 to 20 pounds per cubic foot, or up to 50 pounds per cubic foot in accordance with certain exemplary embodiments. The polyethylene foam may be formed through a process in which gas is injected into the foam during formation. This gas forms air bubbles or gas pockets within the foam that are sealed off to prevent water from entering therein to thus increase the buoyancy of the resulting foam. Additionally or alternatively, the air pockets or gas pockets can be very small which makes water penetration difficult to achieve buoyancy of the product. The polyethylene foam may be closed cell or open cell or a combination of the two. The body 12 may impart any degree of buoyancy to the user and need not fully support the weight of the user when in water but may only partially support the weight of the user.

The body 12 can be made of various materials. For example, the body 12 may be made of closed cell expanded polystyrene foam, or the body 12 can be made of closed cell expanded polyurethane foam. These materials may impart a density of 32 kilograms per cubic meter to the body 12. In other arrangements, the body 12 may be made of polychloroprene and may have a density of 6 pounds per cubic foot, 9 pounds per cubic foot, or 12 pounds per cubic foot. However, it is to be understood that the body 12 may be made of various materials and densities and that the foregoing materials and densities are only exemplary. In certain instances, the body 12 may be made out of a material that is denser than the water into which the user is exercising.

The body 12 may be arranged in the shape of a ring so as to form a closed loop upon itself. The body 12 may be symmetrically formed about an axis 14 in certain exemplary embodiments. However, in other embodiments, the body 12 need not be completely symmetrical about the axis 14. The body 12 can have a cross-sectional shape that is circular, rectangular, triangular, or octagonal in shape. In one embodiment, the body 12 has a cross-sectional shape that is circular and that has a cross-sectional diameter 50 that is 2.25 inches. The body 12 at least partially defines a central aperture 16 through which the axis 14 extends. The central aperture 16 may be large enough so that a foot 42 of the user can be inserted through the central aperture 16. The maximum length 48 in the radial direction 36 of the central aperture 16 may be 4.5 inches when the cross-sectional diameter 50 of the body 12 is 2.25 inches. However, it is to be understood that the maximum length 48 and/or the cross-sectional diameter 50 can be variously sized in other embodiments. For example, the maximum length 48 and/or the cross-sectional diameter 50 may be from 3 to 4 inches, from 4 to 5 inches, from 5 to 7 inches, or up to 10 inches in certain arrangements. The body 12 can be a single, integral component or may be made of various sections that are attached to one another.

The body 12 includes both an inner half 18 and an outer half 22. The inner half 18 includes the first half of the body 12 as taken in the radial direction 36 from the axis 14. The outer half 22 makes up the second half of the body 12 as taken in the radial direction 36 from the axis 14. The entire inner half 18 is thus closer to the axis 14 than the entire outer half 22. The inner half 18 has an outer surface 20 that is oriented generally towards the axis 14, and the outer half 22 has an outer surface 24 that is oriented generally away from the axis 14. The central aperture 16 is at least partially defined by the outer surface 20 of the inner half 18, and no portion of the central aperture 16 is partially defined by the outer surface 24 of the outer half 22. Inner half 18 can be the first half of the body 12 extending in the radial direction 36 from axis 14, and the outer half 22 can be the second half of the body 12 extending in the radial direction 36.

The entire outer surface 24 may be convex in shape. Additionally, the entire outer surface 24 may have the exact same shape in addition to being completely convex in shape. Movement of the aquatic exercise device 10 through the water will thus cause an even amount of drag to be imparted by the outer surface 24 since its entire outer surface 24 is convex in shape and is arranged in an identical manner. Water will flow across the outer surface 24 in the same manner along its entire length minimizing the tendency of the aquatic exercise device 10 to pull the user in a direction in the water due to an uneven flow of water across the outer surface. Hence, the arrangement of the outer surface 24 will not cause the aquatic exercise device 10 to be driven in a particular direction in the water due to uneven drag across the outer surface 24. However, it is to be understood that other arrangements of the aquatic exercise device 10 are possible in which the outer surface 24 is not similarly shaped along its entire length and in which drag is imparted to the device 10 through uneven fluid movement across the outer surface 24.

The outer surface 20 of the inner half 18 may be convex in shape across its entire length. The outer surface 20 may be covered by a ledge 30 along a portion of its length in some arrangements. As such, the central aperture 16 can be defined by a combination of the outer surface 20 and an upper surface 32 of the ledge 30. Hence, the central aperture 16 can be partially defined by the upper surface 32 of the ledge 30, and can be partially defined by the outer surface 20 of the inner half 18. The central aperture 16 may also be defined by a combination of the outer surface 20, upper surface 32, and the outer surfaces of the side walls of the ledge 30. The outer surface 20 may be convex and similarly shaped along an arc length 26. As such, the entire outer surface 20 can be sized and shaped in the same manner along the arc length 26. Arc length 26 may be 270° in some embodiments. In other embodiments of the aquatic exercise device, the arc length 26 may be from 180° to 240°, from 240° to 300°, from 300° to 320°, or up to 360°. Configuration of the outer surface 20 in a convex manner that is the same in shape about the arc length 26 may allow for a consistent drag to be realized about this arc length 26 when moving the device 10 through a body of water. As such, water will flow in a consistent manner along the entire arc length 26 of the outer surface 20 in a manner previously discussed with reference to outer surface 24 thus reducing the tendency of the device 10 to pull the user in a particular direction during use of the device 10. However, it is to be understood that the outer surface 20 need not be convex along the entire arc length 26 or need not be arranged so as to have the same size or shape along arc length 26 in other embodiments.

A ledge 30 may extend from the body 12 in a direction towards the axis 14. The ledge 30 may extend along the outer surface 20 of the inner half 18 an arc length 28 that can be 90°. In other exemplary embodiments, the ledge 30 may extend an arc length 28 that is from 20° to 40°, from 40° to 45°, from 45° to 90°, from 45° to 120°, or up to 180°. The ledge 30 has an upper surface 32 that faces the axis 14 and at least partially defines the central aperture 16. The upper surface 32 affords a surface onto which a portion of the foot 42 of the user can be positioned when using the device during certain exercises. The upper surface 32 may be planar in some embodiments and can be concave in other exemplary embodiments. The ledge 30 may be made of the same material as the body 12, or may be made of different material than the body 12. The ledge 30 may be made of the same materials as discussed above with respect to the body 12, and a repeat of this information is not necessary. The ledge 30 may be integrally formed with the body 12 so that they are essentially a single piece. In this regard, both the ledge 30 and body 12 can be formed through a molding process. Alternatively, the ledge 30 and body 12 may be separately formed and then subsequently connected to one another. The ledge 30 and body 12 may be attached through adhesives such as contact cement or acetone. In other arrangements, the ledge 30 can be attached to the body 12 through the use of mechanical fasteners or other forms of attachment.

The ledge 30 may be arranged so that the ledge 30 is closer to the axis 14 in the radial direction 36 than any portion of the body 12. In this regard, the ledge 30 may be closer to the axis 14 in the radial direction than any portion of the outer surface 20 of the inner half 18 of the body 12. However, other arrangements are possible in which some portion of the outer surface 20 is closer to, or is at the same radial distance to, the axis 14.

Figure 8:
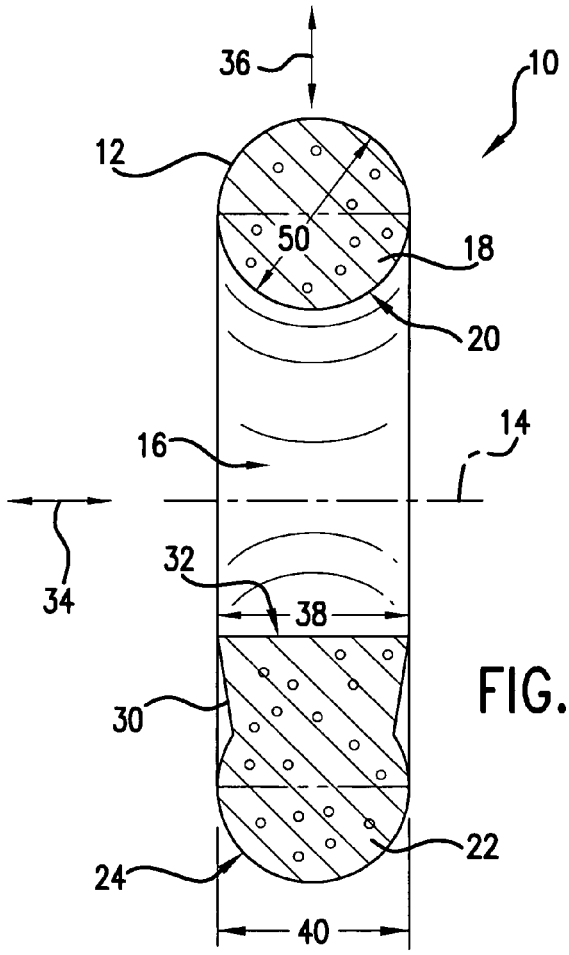
FIG. 8 is a cross-sectional view taken along line 8-8 of FIG. 1.
Figure 9:
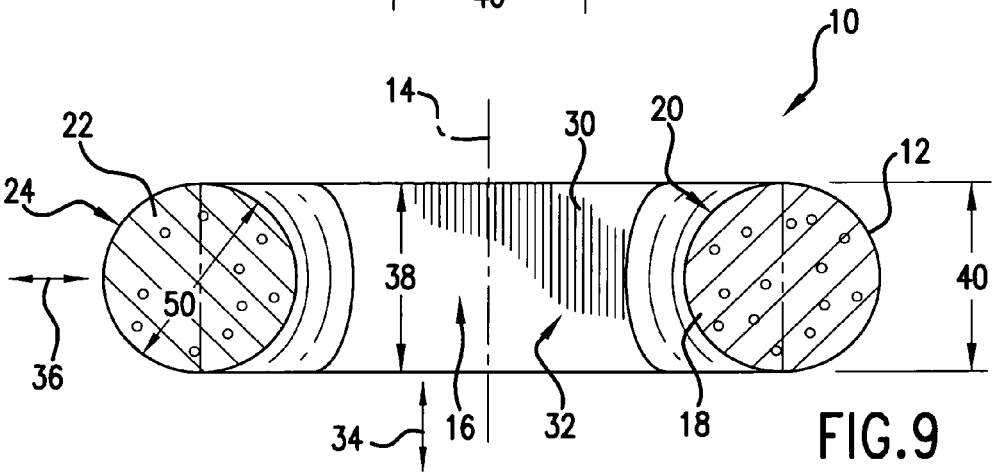
FIG. 9 is a cross-sectional view taken along line 9-9 of FIG. 1.

The ledge 30 may extend from the convex outer surface 20 of the inner half 18 and have side walls that are concave in shape. In other arrangements, the side walls of the ledge 30 that extend from the outer surface 20 are planar in shape or are convex. The side walls of the ledge 30 terminate at the upper surface 32. As shown now with reference to FIGS. 8 and 9, the upper surface 32 can have an axial length 38 that extends in the axial direction 34. The upper surface 32 may be the portion of the ledge 30 that extends the greatest distance in the axial direction 34. The axial length 38 is contained within the axial length 40 of the outer surface 20 of the inner half 18. In this regard, the axial length 38 may be less than or the same as the axial length 40 so that no portion of the ledge 30 extends beyond the body 12 in the axial direction 34. The axial length 38 may be 2.25 inches in certain exemplary embodiments. The axial length 38 may be consistent along the entire length of the upper surface 32 or may vary at points along its length or at its ends.

Figure 10:
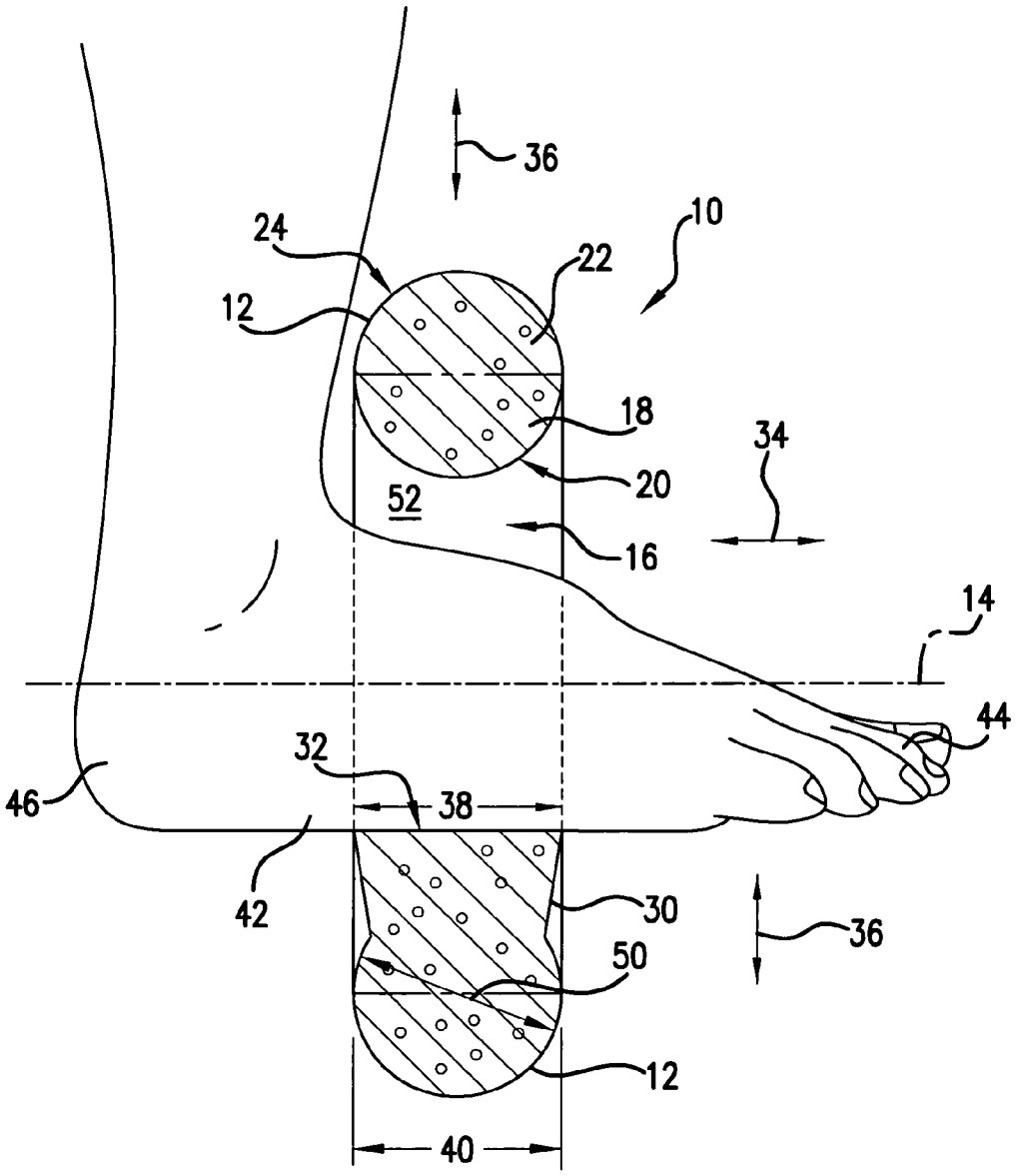
FIG. 10 is a cross-sectional view the device of FIG. 1 with the foot of a user inserted therein.
Figure 11:
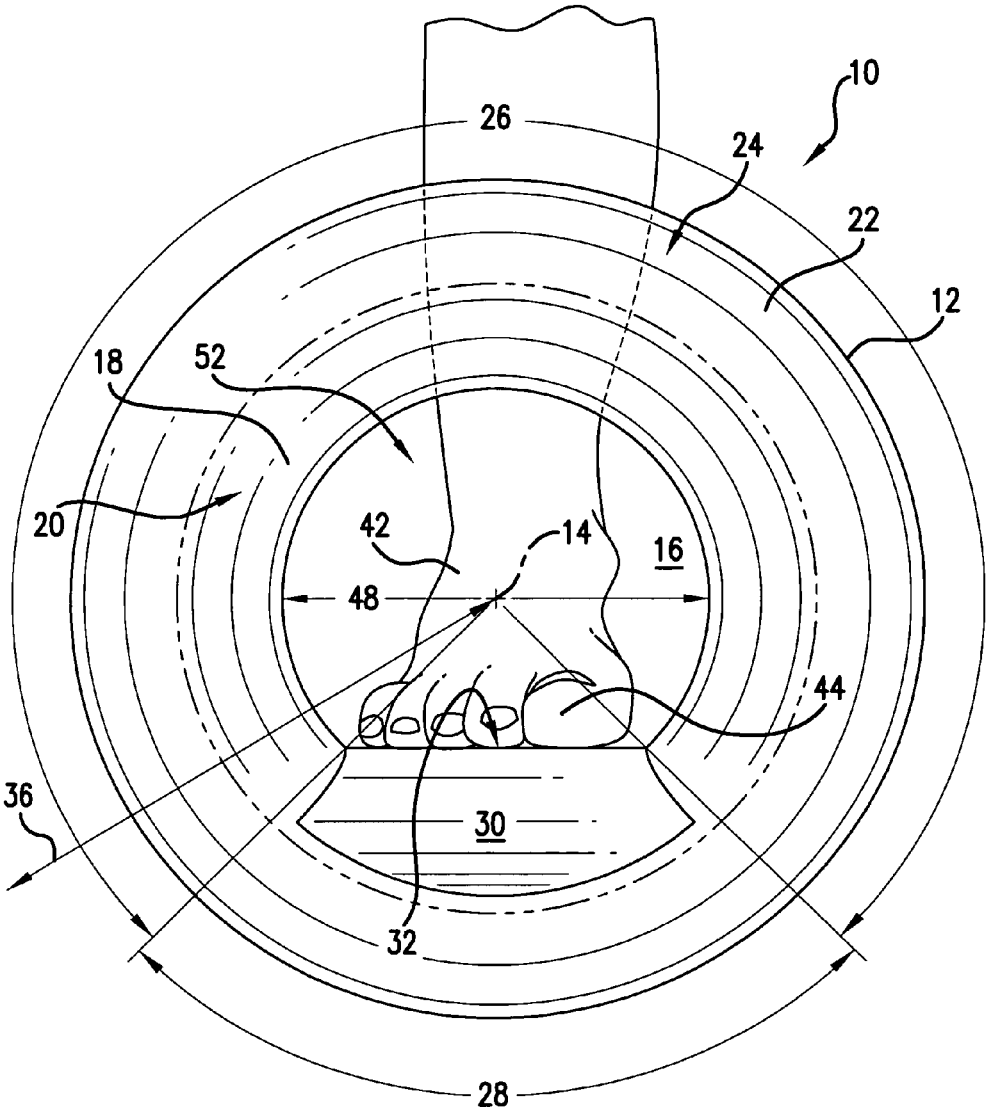
FIG. 11 is a front view of the device of FIG. 1 with the foot of a user inserted therein.

FIGS. 10 and 11 show the foot 42 of the user inserted into the aquatic exercise device 10. Although shown without shoes, it is to be understood that the foot 42 of the user may be covered with a shoe when using the device 10. The foot 42 is positioned so that the bottom of the foot 42, and generally the arch of the foot 42, contacts the upper surface 32 of the ledge 30. A first portion 44 of the foot 42 protrudes forwardly beyond the device 10 in the axial direction 34. The first portion 44 of the foot 42 may include the toes of the foot 42. A second portion 46 of the foot 42 protrudes backwardly beyond the device 10 in the axial direction 34. The second portion 46 may include the heel of the foot 42. However, it is to be understood that in other arrangements, the device 10 can be positioned on the foot 42 so that the upper surface 32 is located against the toes of the foot 42, or so that the heel of the foot 42 contacts the upper surface 32. Buoyancy imparted by the body 12 and/or the ledge 30 will be transferred into the foot 42 of the user so as to fully or partially support the weight of the user when in a body of water.

The foot 42 is positioned within the central aperture 16 so that a space 52 is present between the top of the foot 42 and the outer surface 20 of the inner half 18 of the body 12 that is directly above the foot 42 in the radial direction 36. As such, the foot 42 is positioned between the upper surface 32 of the ledge 30 and the outer surface 20 of the inner half 18 so that a space 52 is between the foot 42 and the outer surface 20. The foot 42 may be positioned so that no portion of the foot 42 contacts the outer surface 20 and so that the only portion of the device 10 that contacts the foot 42 is the upper surface 32. The width of the foot 42 may be smaller than the maximum length 48 of the central aperture 16 in the radial direction 36. However, other arrangements are possible in which the foot 42 contacts the outer surface 20 during use. In this regard, the central aperture 16 may be small enough so that that the foot 42 engages the outer surface 20 at one or both sides of the foot 42 in addition to or alternatively to engagement at the top of the foot 42.

During use of the aquatic exercise device 10, the device 10 will remain on the foot 42 of the user as buoyancy of the device will force the device 10 against the bottom of the foot 42. The user may run in place or move his or her legs in various manners and directions during exercise. Alternatively, the user may keep his or her foot 42 stationary while the device 10 engages his or her foot 42. The user may use an additional device 10 on his or her other foot 42 so that each of the feet 42 of the user may be engaged with a separate device 10. Such an arrangement may provide additional buoyancy and resistance during exercise as desired. With respect to one exercise, the user may place both of his or her feet 42 into a single device 10. The user may then move his or her legs to strengthen same due to buoyancy and resistive forces imparted by the single device 10.

The upper surface 32 of the ledge 30 can have tread imparted thereon so as to effect a better grip with the foot 42. The ledge 30 can be made of foam which will inherently provide the upper surface 32 with some degree of discontinuity thus facilitating a better hold onto the foot 42. Indentations or other cuts may be made into the upper surface 32 to enhance gripping thereof. In other arrangements, the upper surface 32 can be flat, or may have only slight irregularities thereon due to the texture of the foam that may make up the upper surface 32 of the ledge 30.

In one exemplary embodiment, the device 10 as shown in FIGS. 1-11 has an overall maximum diameter of 25.46 centimeters which measures in the radial direction 36 from the meeting point of the outer surfaces 20 and 24 to another meeting point of the outer surfaces 20 and 24 on the other side of the device 10. The maximum size of the central aperture 16 in the radial direction 36 is 13.46 centimeters which measures from a point on the outer surface 20 to an opposite point on the outer surface 20 on the other side of the central aperture 16. The outer circumference of the body 20 is 80 centimeters, and this outer circumference is measured around the body 20 at the meeting point of the outer surfaces 20 and 24 and represents the maximum circumference of the body 12. The length of the body 12 in the axial direction 34 is 6 centimeters, and this distance is the same as the axial length 40. The axial length 38 is 6 centimeters, and the length of the upper surface 32 is 10 centimeters. The length of the upper surface 32 is measured in a direction that is perpendicular to the axial direction 34. If the upper surface 32 were rectangular in shape, the axial length 38 would be the smaller side length of the upper surface 32, and the length would be the longer side of the rectangular upper surface 32. Although described as having particular dimensions, it is to be understood that the aforementioned dimensions are only present in one or more exemplary embodiments of the device 10 and are not present in all embodiments. The device 10 may be provided to the public with the same dimensions but have different foam densities. Devices 10 can be provided with three different foam densities to support users of different weight categories. The user may select a device 10 based upon how much support he or she needs during a particular exercise.

Figure 12:
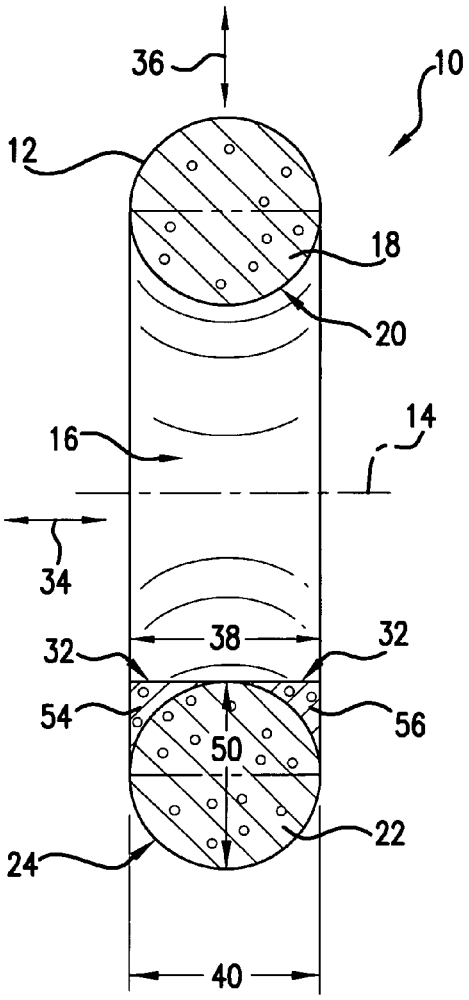
FIG. 12 is a cross-sectional view of an aquatic exercise device in accordance with an alternative exemplary embodiment.

The aquatic exercise device 10 can be variously arranged in accordance with other exemplary embodiments. With reference now to FIG. 12, the ledge 30 is composed of a pair of sections 54 and 56. A first section 54 extends from the outer surface 20 of the inner half 18 and includes a planar upper surface 32. The ledge 30 also includes a second section 56 that likewise extends from the outer surface 20 and has a planar upper surface 32. The first section 54 is separate from the second section 56, and the upper surface 32 of both of the sections 54 and 56 are arranged at the same radial distance from the axis 14 as one another. A portion of the outer surface 20 of the inner half 18 is located between the sections 54 and 56 and may be contacted by the user when the user places his or her foot 42 onto the device 10 for use. As such, the bottom portion of the foot 42 may contact both the outer surface 20 and the upper surface 32 of the sections 54 and 56 during use of the device 10. The outer surface 20 may be located closer to the axis 14 than the upper surface 32 in the radial direction 36, or the upper surface 32 may be located closer to the axis 14 than the outer surface 20. In other arrangements, the upper surface 32 may be located the same distance in the radial direction 36 from the axis 14 as the outer surface 20.

Figure 13:
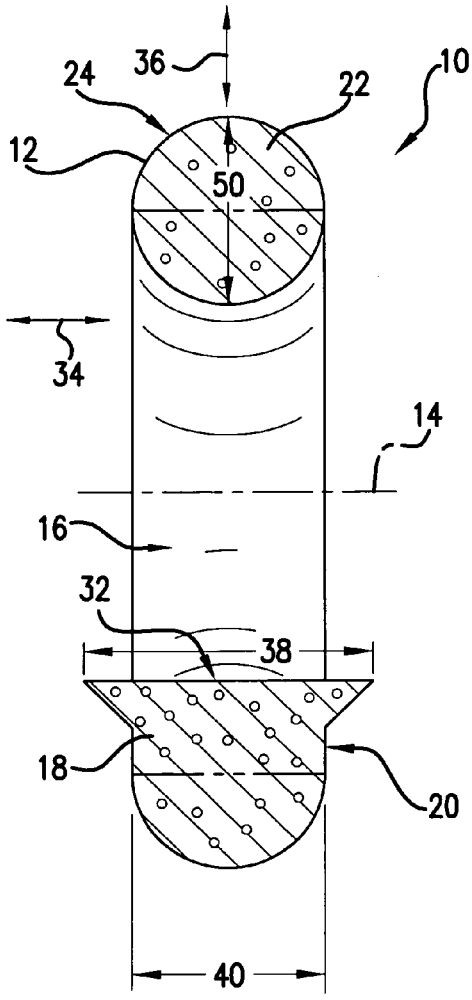
FIG. 13 is a cross-sectional view of an aquatic exercise device in accordance with another alternative exemplary embodiment.

An alternative exemplary embodiment of the aquatic exercise device 10 is shown in FIG. 13. Here, the ledge 30 extends a greater distance in the axial direction 34 than does the body 12. Such an arrangement may function to increase the holding ability of the device 10 to the foot 42 during use as the longer ledge 30 will contact a greater portion of the foot 42 of the user. The axial length 38 of the upper surface 32 can extend beyond the axial length 40 of the inner half 18 both forwardly and rearward in the axial direction 34. In other arrangements, the upper surface 32 may extend forward beyond the outer surface 20 in the axial direction 34 but may not extend rearward beyond the outer surface 20 in the axial direction 34. In yet other arrangements, the opposite may be true in which the upper surface 32 extends rearward beyond the outer surface 20 in the axial direction 34 but does not extend forwardly beyond the outer surface 20 in the axial direction 34.

Figure 14:
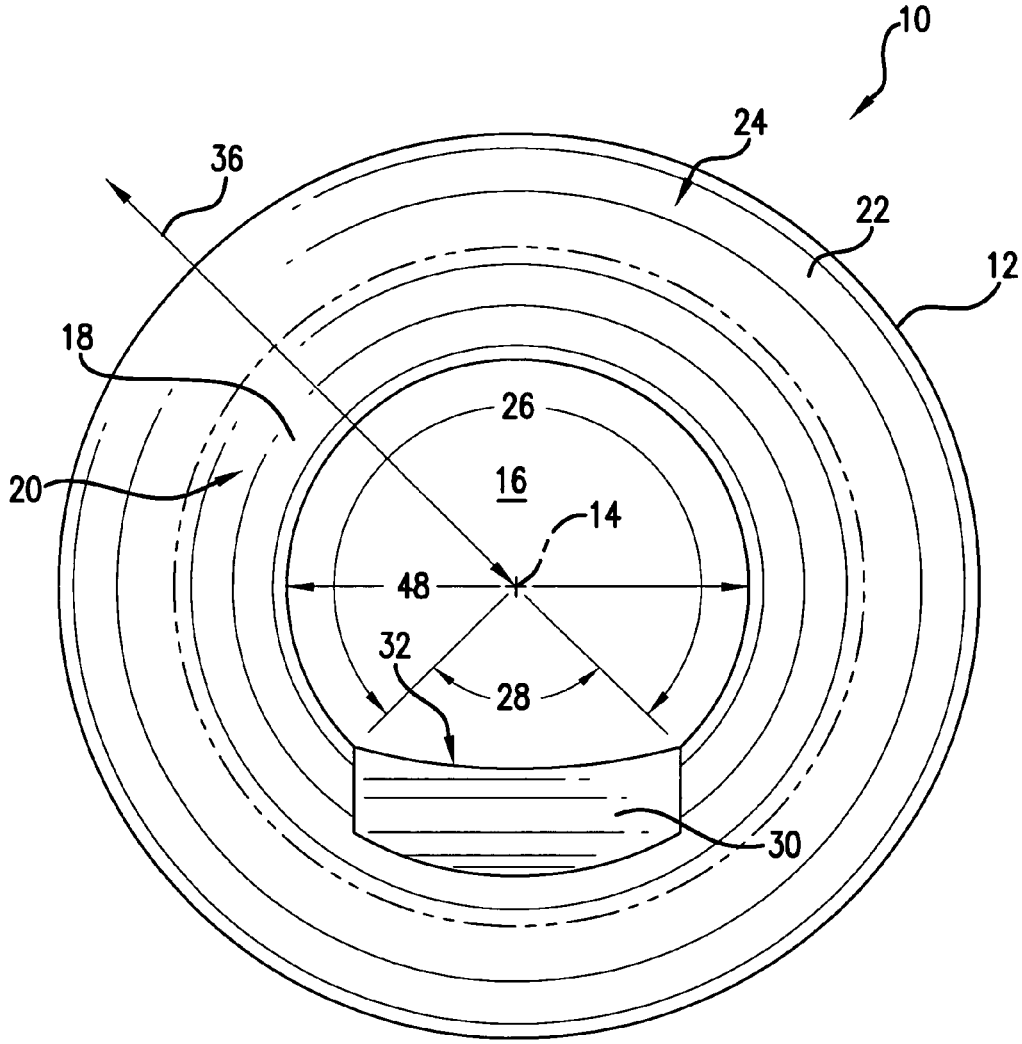
FIG. 14 is a front view of an aquatic exercise device in accordance with another alternative exemplary embodiment.

Another arrangement of the aquatic exercise device 10 is illustrated with reference to FIG. 14. Here, the ledge 30 has an upper surface 32 that is concave in shape and that is not planar in shape. The radius of curvature of the upper surface 32 may be different than the radius of curvature of the outer surface 20 of the inner half 18 about the axis 14. However, in other embodiments, the radius of curvature of the upper surface 32 may be the same as that of the outer surface 20 such that the upper surface 32 essentially tracks the outer surface 20 and is simply offset therefrom in the radial direction 36.

Although shown and described as being held by the foot 42 of the user, the aquatic exercise device 10 may be held by the hand of the user during exercise in other embodiments. The user may grasp the body 12 and/or the ledge 30 and can push same through the water. Buoyancy and water resistance forces of the device 10 will function to build user strength and endurance during exercise. The device 10 can be pushed down in the water by one or both hands of the user. Alternatively, a pair of the devices 10 can be employed and the user can hold one in each hand during a particular exercise. An arm of the user may be inserted through the central aperture 16 in one embodiment to provide buoyancy to the user during a particular exercise. An additional device 10 can be inserted onto the other arm of the user to provide increased buoyancy if desired.

The device 10 can be sized so that the body 12 and accommodating central aperture 16 are large enough to be grasped by someone with arthritis or other condition that leaves them incapable of holding smaller objects. A single device 10 may be needed by an instructor when conducting a water aerobics class. However, other arrangements are possible in which the instructor will use from 2-4 devices 10 when conducting a water aerobics class. The user may hold a device 10 in each hand when performing certain types of exercises much in the same way a gymnast holds onto a pair of rings when performing. As such, the device 10 can be used with a wide array of exercises, provides buoyancy, and allows the instructor to instruct a class through the use of a single device 10 and not a plurality of devices 10 in certain embodiments.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

What is claimed is:

1. An aquatic exercise device for providing some degree of buoyancy to a user when in water, comprising:

a body made of foam, wherein the body extends 360° about an axis and at least partially defines a central aperture that extends through the axis, wherein the body has an inner half that has an outer surface that is oriented generally towards the central aperture, wherein the body has an outer half that has an outer surface that is oriented generally away from the central aperture, wherein the outer surface of the outer half of the body is convex in shape; and a ledge that extends from the inner half of the body, wherein the ledge has an upper surface that at least partially defines the central aperture, wherein the upper surface of the ledge is closer to the axis than any portion of the body in a radial direction, and wherein the upper surface of the ledge is configured to receive a foot of the user such that a first portion of the foot of the user is configured to be located forwardly in an axial direction beyond the body and the ledge, wherein the upper surface of the ledge has a first terminal end located at the inner half and extends to a second terminal end located at a different location at the inner half, wherein the ledge has a side wall that is solid across an entire surface of the side wall that extends from the inner half to the upper surface along an entire arc length from the first terminal end located at the inner half to the second terminal end located at the different location at the inner half.

2. The aquatic exercise device as set forth in claim 1, wherein the upper surface of the ledge is configured to receive the foot of the user such that a second portion of the foot of the user is located backwardly in the axial direction beyond the body and the ledge.

3. The aquatic exercise device as set forth in claim 2, wherein the first portion of the foot of the user includes the toes, and wherein the second portion of the foot of the user includes the heel.

4. The aquatic exercise device as set forth in claim 1, wherein the entire outer surface of the inner half of the body is convex in shape along an arc length of at least 270° of the inner half of the body about the axis, and wherein the entire outer surface of the outer half of the body is convex in shape.

5. The aquatic exercise device as set forth in claim 1, wherein the body has a circular cross-sectional shape that has a cross-sectional diameter that is between 1.75 and 2.5 inches, and wherein the central aperture has a maximum length in the radial direction of 4.5 inches, and wherein a space is present between the foot of the user and the body in the radial direction such that the foot of the user is located between the upper surface of the ledge and the space, and wherein the ledge and the body are integrally formed with one another and are both made of polyethylene foam that has a density less than 62.4 pounds per cubic foot.

6. The aquatic exercise device as set forth in claim 1, wherein the upper surface of the ledge is planar and is arranged such that the axis does not extend through the planar upper surface of the ledge, and wherein the upper surface of the ledge extends along an arc length of the inner half of the body that is less than or equal to 90° about the axis.

7. The aquatic exercise device as set forth in claim 1, wherein the ledge does not extend in the axial direction beyond the outer surface of the inner half of the body such that the axial length of the ledge is not greater than the axial length of the outer surface of the inner half of the body.

8. The aquatic exercise device as set forth in claim 1, wherein the upper surface of the ledge is configured for direct contact with the foot of the user.

9. An aquatic exercise device, comprising:

a body made of foam, wherein the body extends 360° about an axis and at least partially defines a central aperture that extends through the axis, wherein the body has an inner half that has an outer surface that is oriented generally towards the central aperture, wherein the body has an outer half that has an outer surface that is oriented generally away from the central aperture, wherein the entire outer surface of the outer half of the body is convex in shape, and wherein the outer surface of the inner half of the body is convex in shape along an arc length of at least 270° of the inner half of the body about the axis; and a ledge that extends from the inner half of the body, wherein the ledge has an upper surface that at least partially defines the central aperture, wherein the upper surface of the ledge has a first terminal end located at the inner half and extends to a second terminal end located at a different location at the inner half, wherein the ledge has a side wall that is solid across an entire surface of the side wall that extends from the inner half to the upper surface along an entire arc length from the first terminal end located at the inner half to the second terminal end located at the different location at the inner half.

10. The aquatic exercise device as set forth in claim 9, wherein the foam is polyethylene foam and has a density less than 62.4 pounds per cubic foot.

11. The aquatic exercise device as set forth in claim 9, wherein the body has a circular cross-sectional shape, and wherein the entire outer surface of the inner half of the body is convex in shape along an arc length of 360° of the inner half of the body about the axis such that the entire outer surfaces of both the inner and outer halves of the body are convex in shape.

12. The aquatic exercise device as set forth in claim 9, wherein the upper surface is planar and is arranged such that the axis does not extend through the planar upper surface of the ledge.

13. The aquatic exercise device as set forth in claim 9, wherein the ledge is made of the same type of foam as the body and the upper surface is concave in shape, wherein the ledge extends along the inner half of the body an arc length that is less than or equal to 90° about the axis.

14. The aquatic exercise device as set forth in claim 9, wherein the ledge does not extend in the axial direction beyond the outer surface of the inner half of the body such that the axial length of the ledge is not greater than the axial length of the outer surface of the inner half of the body.

15. An aquatic exercise device for providing some degree of buoyancy to a user when in water, comprising:

a body made of foam, wherein the body extends 360° about an axis, wherein the body has an inner half that at least partially defines a central aperture and that has an outer surface that is oriented generally towards the central aperture, wherein the entire outer surface of the inner half of the body is convex in shape along an arc length of at least 270° of the inner half of the body about the axis, wherein the body has an outer half that has an outer surface that is oriented generally away from the central aperture, wherein the entire outer surface of the outer half of the body is convex in shape; and a ledge made of foam that has an upper surface that at least partially defines the central aperture, wherein the upper surface of the ledge is planar and is arranged such that the axis does not extend through the planar upper surface of the ledge, wherein the upper surface of the ledge is closer to the axis than any portion of the body in a radial direction, and wherein the upper surface of the ledge extends along an arc length of the inner half of the body that is less than or equal to 90° about the axis, wherein the upper surface of the ledge has a first terminal end located at the inner half and extends to a second terminal end located at a different location at the inner half, wherein the ledge has a side wall that is solid across an entire surface of the side wall that extends from the inner half to the upper surface along an entire arc length from the first terminal end located at the inner half to the second terminal end located at the different location at the inner half;

wherein the upper surface of the ledge is configured to receive a foot of the user such that a first portion of the foot of the user that includes toes of the foot is located forwardly in an axial direction beyond the body and the ledge, and wherein the upper surface of the ledge is configured to receive the foot such that a second portion of the foot of the user that includes a heel of the foot is located backwardly in the axial direction beyond the body and the ledge.

* * * * *